United States Patent [19]

O'Keefe, II et al.

[11] Patent Number: 4,909,760

[45] Date of Patent: Mar. 20, 1990

[54] ELECTRICAL CONNECTOR HAVING COMBINATION CABLE AND BOLT SEAL

[75] Inventors: John J. O'Keefe, II, Cortland; Robert M. Bartley, Ravenna, both of Ohio

[73] Assignee: General Motors Corporation, Detroit, Mich.

[21] Appl. No.: 328,846

[22] Filed: Mar. 27, 1989

[51] Int. Cl.[4] ..... H01R 11/00

[52] U.S. Cl. ..... 439/556; 439/559; 439/587

[58] Field of Search ..... 439/277, 279, 275, 548, 439/556, 559, 587, 552, 364, 733

[56] References Cited

U.S. PATENT DOCUMENTS

| | | | |
|---|---|---|---|
| 3,146,052 | 8/1964 | Burch et al. | 339/91 |
| 4,225,206 | 9/1980 | Roman, Jr. | 439/274 |
| 4,684,190 | 8/1987 | Clark et al. | 439/587 |
| 4,711,509 | 12/1987 | Cross et al. | 439/587 |

*Primary Examiner*—Z. R. Bilinsky

*Attorney, Agent, or Firm*—F. J. Fodale

[57] ABSTRACT

A sealed electrical connector has an annular elastomeric seal pad which seals the openings of the terminal cavities as well as a bolt hole at the cable end of the connector. The seal pad is disposed in a well formed by an integral shroud of the connector body and the bolt hole extends through a bolt tower of the connector body which projects into the well.

4 Claims, 1 Drawing Sheet

ELECTRICAL CONNECTOR HAVING COMBINATION CABLE AND BOLT SEAL

BACKGROUND OF THE INVENTION

This invention relates generally to electrical connectors and more specifically to sealed electrical connectors which include a bolt to fasten the electrical connector to a mating electrical connector.

U.S. Pat. No. 4,684,190 granted to Roger A. Clark, Paul D. Doherty and Emil J. Tolnar, Jr. on Aug. 4, 1987 discloses a sealed electrical "bulkhead" connector which is sealingly secured to an apertured bulkhead by a bolt which fastens the bulkhead connector to a mating electrical connector on the opposite side of the bulkhead. The terminal cavities at the cable end of the bulkhead connector are sealed by individual cable seals. The bolt passage is sealed at the cable end by an O-ring seal which is compressed into sealing engagement with the underside of the bolt head.

It is also known that the cable end of a multiple terminal electrical connector can be sealed by a common seal pad having a plurality of sealing apertures which seal around the cables which exit the terminal cavities at the cable end of the connector body, such as, for instance, is shown in U.S. Pat. No. 4,711,509 granted to William E. Cross, Jeanne Hillestad, and Robert G. Plyler on Dec. 8, 1987.

SUMMARY OF THE INVENTION

The object of this invention is to provide an improved sealed electrical connector which is configured so that a single elastomeric seal pad seals the bolt passage as well as the terminal cavities at the cable end of the connector body.

A feature of the invention is that the connector body has an integral shroud at the cable end of the connector body which forms a well for receiving the elastomeric seal pad.

Another feature of the invention is that the connector body has an integral bolt tower which projects into the well at the cable end of the connector body.

Another feature of the invention is that the elastomeric seal pad is in the form of an annular seal pad which is fitted into the well around the bolt tower at the cable end of the connector body.

Yet another feature of the invention is that the elastomeric seal pad has an annular sealing lip which acts independently of the elastomeric seal body to seal the bolt hole.

Still yet another feature of the invention is that the bolt tower is sized to limit compression of the annular sealing lip which seals the bolt hole so as to prevent damage to the annular sealing lip.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
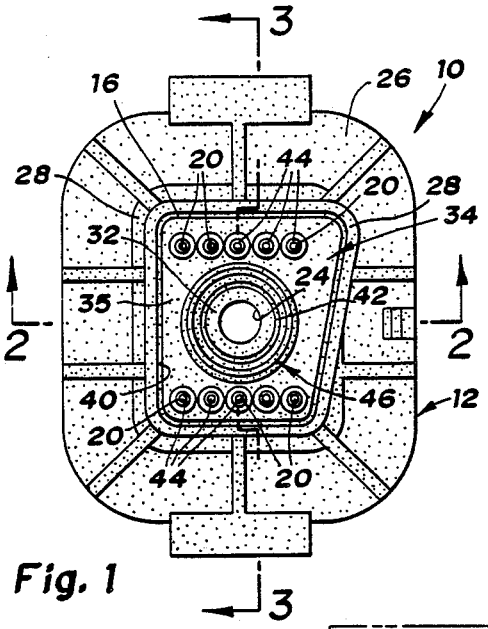
FIG. 1 is a cable end view of a sealed electrical connector in accordance with the invention.
Figure 3:
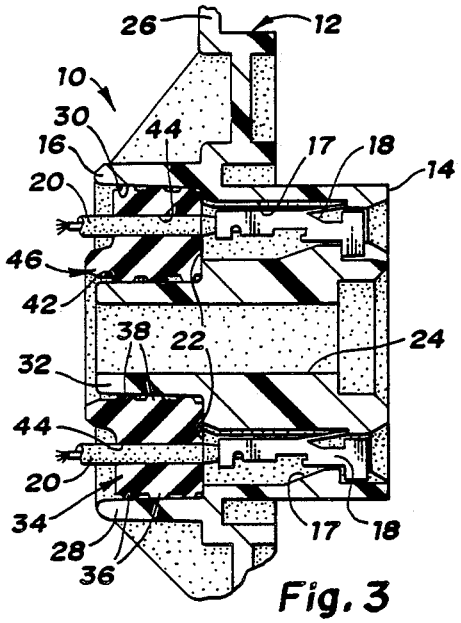
FIG. 3 is a section taken substantially along the line 3—3 of FIG. 1 looking in the direction of the arrows.
Figure 2:
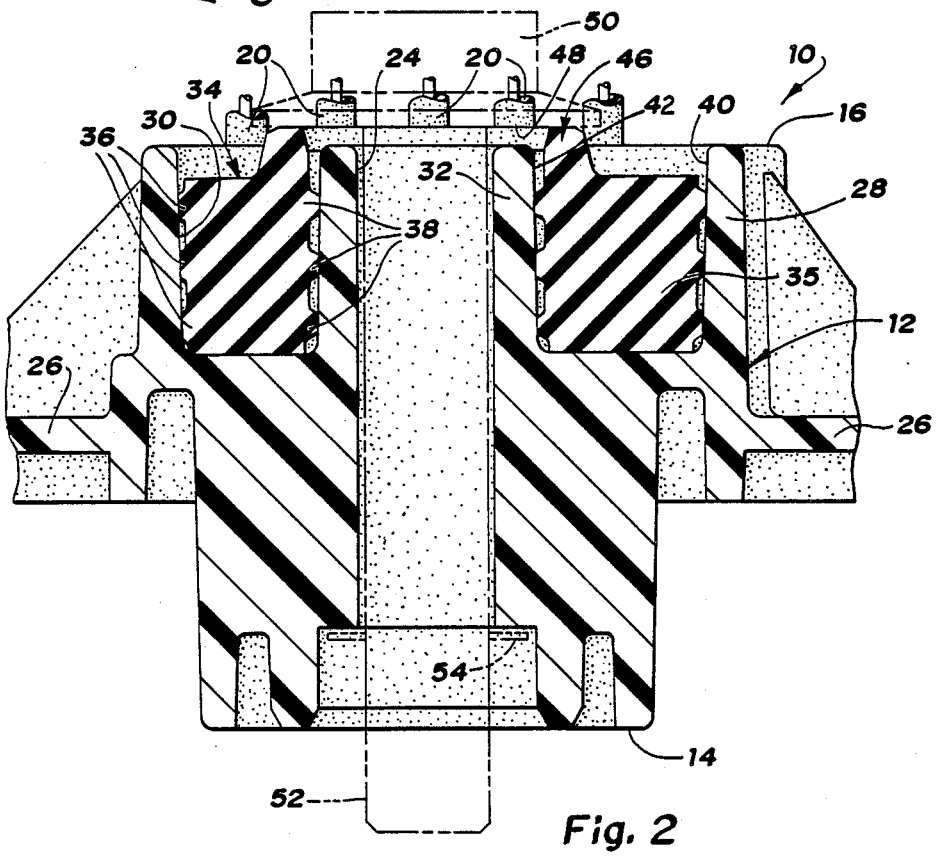
FIG. 2 is a section taken along the line 2—2 of FIG. 1 looking in the direction of the arrows.

Referring now to the drawing, the sealed electrical connector 10 comprises a connector body 12 which has a contact end 14 and a cable end 16. The connector body 12 also has a plurality of terminal cavities 17 which house electrical terminals 18 which are attached to electrical cables 20 in a conventional manner. The electrical cables 20 extend out of terminal cavities 17 through openings 22 at the cable end of the connector body 12.

By way of background, electrical "bulkhead" connectors are commonly attached to a bulkhead or panel so as to extend through an aperture or hole in the bulkhead and connect to a mating electrical connector on the opposite side of the bulkhead. U.S. Pat. No. 4,684,190 (Clark et al) which is mentioned above shows a typical installation in which the mating connectors are bolted together. In automotive applications, the bulkhead connectors are commonly used on the bulkhead between the engine and the passenger compartments of the automobile and consequently the bulkhead connector on the engine side is sealed at the bulkhead panel and at the cable end.

The sealed electrical connector 10 is adapted for use as a bulkhead connector. Thus the connector body 12 has a bolt hole 24 which extends through the connector body 12 from the contact end 14 to the cable end 16 and a flange 26 which holds and presses a face seal (not shown) against a bulkhead (not shown) when the connector body 12 is attached to the bulkhead.

The sealing arrangement for the cable end of the connector body 12 comprises an integral shroud 28 at the cable end of the connector body 12 which forms a well 30 which surrounds the openings 22 of the terminal cavities 17 and the bolt hole 24. The sealing arrangement further includes a bolt tower 32 which is integrally attached to the connector body 12 and projects into the well 30 at the cable end. The bolt hole 24 extends through the bolt tower 32.

The sealing arrangement further includes an annular elastomeric seal pad 34 of silicone or other suitable sealing material which seals the bolt hole 24 as well as the openings 22 of the terminal cavities 17 at the cable end of the connector body 12. The annular seal pad 34 is disposed in the well 30. It has a main body 35 of substantially rectangular cross section. The body 35 has a plurality of external and internal sealing ribs 36 and 38 which are in sealing engagement with an internal wall 40 of the shroud 28 and an external wall 42 of the bolt tower 32, respectively.

The annular seal pad 34 also has a plurality of sealing apertures 44 which extend through the main body 35 for receiving and sealing around the electrical cables 20 which extend out of the openings 22 of the terminal cavities 17 at the cable end of the connector body 12.

The seal pad 34 further includes an annular seal lip 46 which is raised up from the main body 35 so as to act independently of the sealing ribs 36 and 38 and the sealing apertures 44. The annular seal lip 46 surrounds and extends above the bolt tower 32 for sealing against a shoulder 48 provided by the underside of the bolt head 50 on a bolt 52 which is disposed in the bolt hole 24 and retained by a retainer ring 54. The bolt tower 32 has a height which is greater than the height of the main body 35 of the annular seal pad 34 so as to limit the compression of the annular seal lip 46 when the bolt 52 is connected to a nut carried by the cooperating connector (not shown) and tightened down.

The height of the bolt tower 32 is preselected so that the compression of the annular seal lip 46 does not cause any damage to the seal pad 34 when the bolt head 50 bottoms out on the bolt tower 32.

It should also be noted that the bolt 52 and retainer 54 also retain the elastomeric seal pad 34 in assembly with the connector body 12 during handling of the electrical connector 10.

We wish it to be understood that we do not desire to be limited to the exact details of construction shown and described, for obvious modifications will occur to a person skilled in the art.

The embodiments of the invention in which an exclusive property or privilege is claimed are defined as follows:

1. In a sealed electrical connector having a connector body which has a contact end and a cable end, the connector body having a plurality of terminal cavities which house terminals attached to electrical cables which extend out of openings at the cable end of the connector body and the connector body having a bolt hole which extends through the connector body from the contact end to the conductor end, the improvement comprising:

the connector body having an integral shroud at the cable end which provides a well which surrounds the openings of the terminal cavities and the bolt hole the connector body further having an integral bolt tower at the cable end which projects in the well and through which the bolt hole extends, and an annular elastomeric seal pad which is disposed in the well in sealing engagement with an internal wall of the shroud and an external wall of the bolt tower, the annular seal pad having a plurality of sealing apertures which extend through the seal pad for receiving and sealing around the electrical cables which extend out of the openings of the terminal cavities at the cable end of the conductor body, and the seal pad having an annular seal lip which surrounds and extends above the bolt tower for sealing against a shoulder of a bolt when the bolt is disposed in the bolt hole and tightened down.

2. An improved sealed electrical connector as defined in claim 1 wherein the annular elastomeric seal pad has a main body of substantially rectangular cross section and the annular seal lip is raised up from the main body portion so as to act substantially independently of the sealing ribs and the sealing apertures.

3. An improved sealed electrical connector as defined in claim 2 wherein the bolt tower has a height which is greater than the height of the main body of the annular seal pad so as to limit compression of the annular seal lip.

4. An improved sealed electrical connector as defined in claim 3 wherein a bolt is disposed and retained in the bolt hole by a retainer so that the bolt retains the annular seal pad in assembly with the connector body during handling of the electrical connector.

* * * * *